US009541895B1

(12) United States Patent
Kuroda et al.

(10) Patent No.: US 9,541,895 B1
(45) Date of Patent: Jan. 10, 2017

(54) IMAGE FORMING APPARATUS INCLUDING A FIRST AIR BLOWING DEVICE AND A SECOND AIR BLOWING DEVICE

(71) Applicant: FUJI XEROX Co., Ltd., Tokyo (JP)

(72) Inventors: Mitsuaki Kuroda, Kanagawa (JP); Akira Harada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/994,706

(22) Filed: Jan. 13, 2016

(30) Foreign Application Priority Data

Jul. 17, 2015 (JP) ..... 2015-143020

(51) Int. Cl.
*G03G 21/20* (2006.01)
*G03G 21/16* (2006.01)

(52) U.S. Cl.
CPC ..... *G03G 21/1638* (2013.01)

(58) Field of Classification Search
CPC ..... G03G 21/1638; G03G 21/206
USPC ..... 399/92, 124, 341
See application file for complete search history.

(56) References Cited

U.S. PATENT DOCUMENTS 8,301,055 B2 * 10/2012 Kojima ..... G03G 21/206 399/92
8,351,814 B2 * 1/2013 Kasuga ..... G03G 21/206 399/92
8,396,382 B2 * 3/2013 Mori et al. ..... G03G 15/6573 399/92

FOREIGN PATENT DOCUMENTS

JP 04-274450 A 9/1992
JP 2013-035692 A 2/2013

* cited by examiner

*Primary Examiner* — William J Royer
(74) *Attorney, Agent, or Firm* — Sughrue Mion, PLLC

(57) ABSTRACT

An image forming apparatus includes an image forming section that forms a toner image, an output section, a sheet transport unit that transports in a region above the image forming section a sheet onto which the toner image has been fixed toward the output section in a substantially horizontal direction, a first air blowing device that applies on an upper side of the sheet being transported an airflow directed from a downstream side to an upstream side in a sheet transport direction of the sheet transport unit, and a second air blowing device that applies an airflow directed from the downstream side to the upstream side in the sheet transport direction of the sheet transport unit in a region that is on an upper side of the image forming section and on a lower side of the sheet.

12 Claims, 5 Drawing Sheets

IMAGE FORMING APPARATUS INCLUDING A FIRST AIR BLOWING DEVICE AND A SECOND AIR BLOWING DEVICE

CROSS-REFERENCE TO RELATED APPLICATIONS

This application is based on and claims priority under 35 USC 119 from Japanese Patent Application No. 2015-143020 filed Jul. 17, 2015.

BACKGROUND

Technical Field

The present invention relates to an image forming apparatus.

SUMMARY

According to an aspect of the present invention, an image forming apparatus includes an image forming section, an output section, a sheet transport unit, a first air blowing device, and a second air blowing device. The image forming section forms a toner image. The sheet transport unit transports in a region above the image forming section a sheet onto which the toner image has been fixed toward the output section in a substantially horizontal direction. The first air blowing device applies on an upper side of the sheet being transported an airflow directed from a downstream side to an upstream side in a sheet transport direction of the sheet transport unit. The second air blowing device applies an airflow directed from the downstream side to the upstream side in the sheet transport direction of the sheet transport unit in a region that is on an upper side of the image forming section and on a lower side of the sheet.

BRIEF DESCRIPTION OF THE DRAWINGS

An exemplary embodiment of the present invention will be described in detail based on the following figures, wherein.

DETAILED DESCRIPTION

Next, an exemplary embodiment and a specific example of the present invention will be described in further detail below with reference to the drawings. It should be understood that the present invention is not limited to the exemplary embodiment and the specific example.

Furthermore, it should be noted that the drawings referred to in the following description are schematically illustrated and not to scale, and illustration of elements not required for the description is omitted as appropriate for ease of understanding.

(1) An Overall Structure and Operations of an Image Forming Apparatus

Figure 1A:
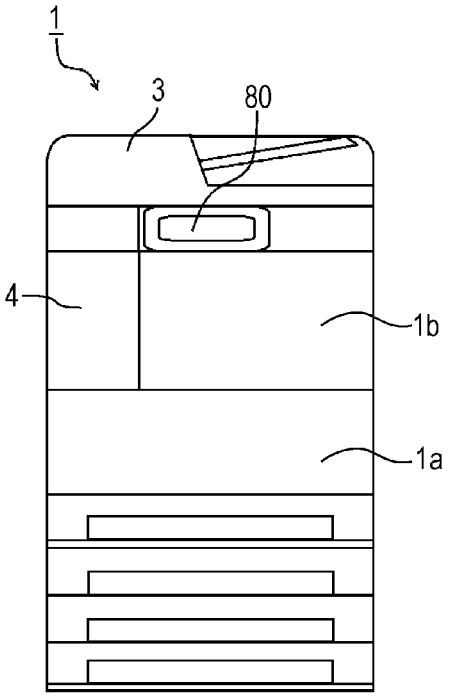
FIG. 1A is a front view of the appearance of an entirety of an image forming apparatus.
Figure 1B:
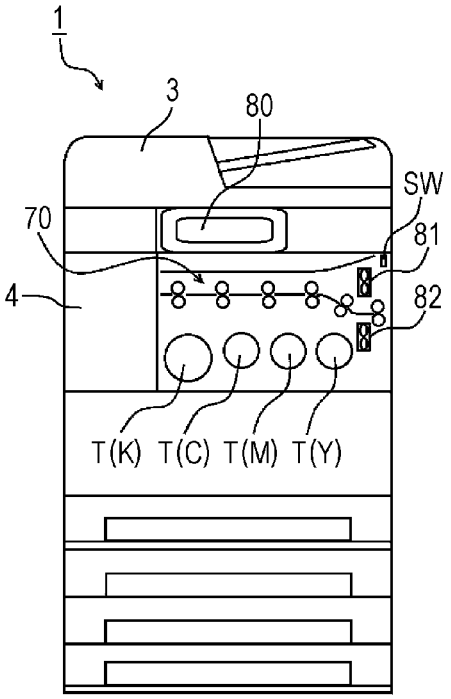
FIG. 1B is a front view of the image forming apparatus with a sheet transport section exposed.
Figure 2:
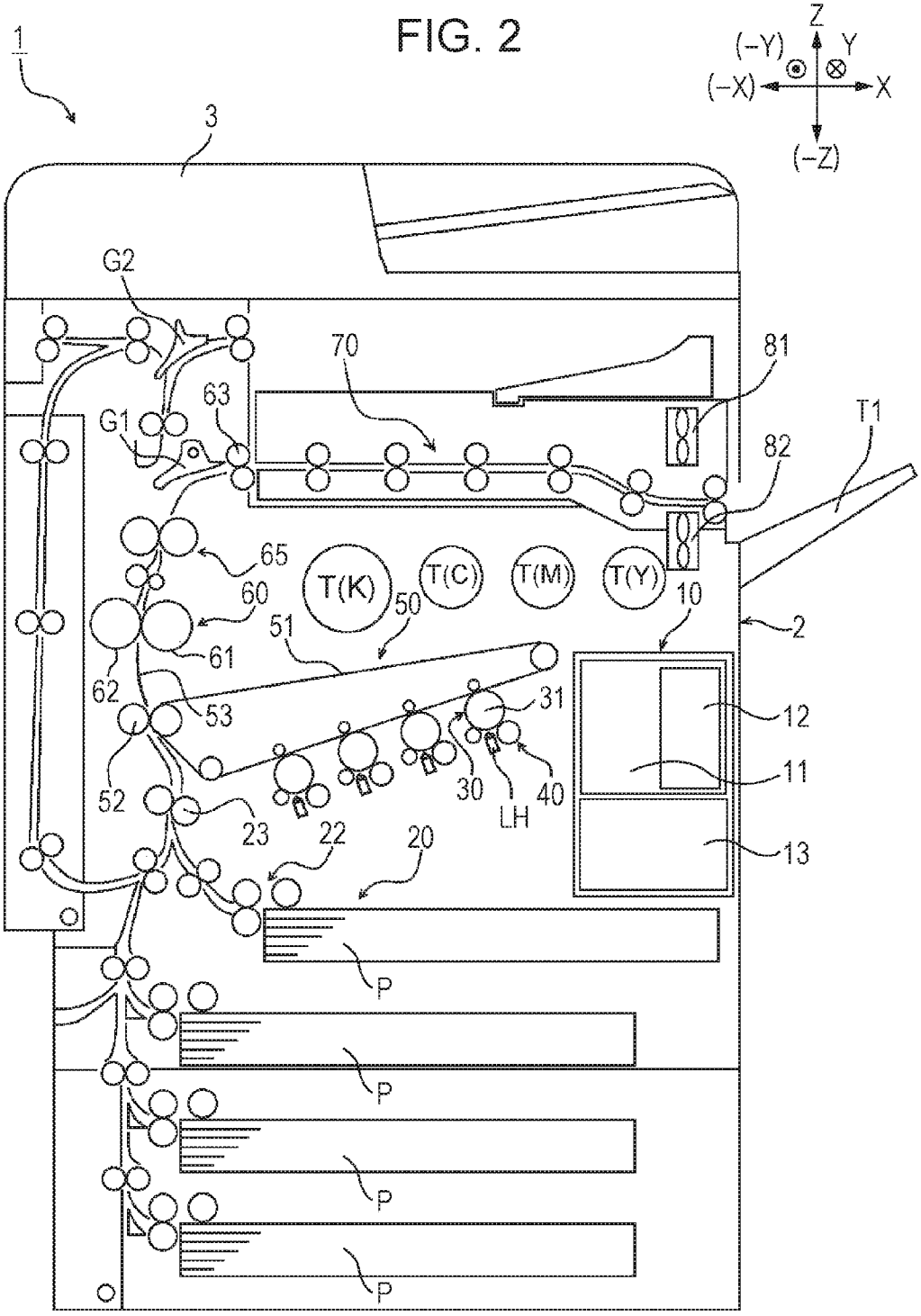
FIG. 2 is a schematic sectional view of an internal structure of the image forming apparatus.

FIG. 1A is a front view of the appearance of an entirety of an image forming apparatus 1, FIG. 1B is a front view of the image forming apparatus 1 with a sheet transport section exposed, and FIG. 2 is a schematic sectional view of an internal structure of the image forming apparatus 1.

An overall structure and operations of the image forming apparatus 1 are described below with reference to the drawings.

(1.1) The Overall Structure

The image forming apparatus 1 includes an image forming section 2 and an image reader 3. The image forming section 2 forms an image with an electrophotographic system. The image reader 3 reads a document and the like and is supported at a position above the image forming section 2 by an image reader support unit 4. A sheet transport device 70 is disposed between the image forming section 2 and the image reader 3. The sheet transport device 70 transports a sheet onto which an image has been fixed to an output section.

The image forming section 2 is structured as follows: a controlling device 10, sheet feed devices 20, photosensitive units 30, developing devices 40, a transfer device 50, and a fixing device 60 are disposed in a space formed by a housing (not illustrated); the photosensitive units 30, the developing devices 40, and the transfer device 50 are shielded by a first front covering 1*a*; and toner cartridges T(Y), T(M), T(C), and T(K) and the sheet transport device 70 are shielded by a second front covering 1*b* serving as an opening/closing member at a position above the first front covering 1*a*.

An operation and information unit 80 serving as a user interface is disposed on a front surface side of the image reader 3. A liquid crystal display panel, various types of buttons, a touch panel, and the like are assembled together to form the operation and information unit 80. A user of the image forming apparatus 1 makes various types of settings and inputs instructions via the operation and information unit 80. The user of the image forming apparatus 1 is notified of various types of information via the liquid crystal display panel.

(1.2) The Image Forming Section

The controlling device 10 includes a controller 11, an image processing unit 12, a power source unit 13 and the like. The controller 11 controls operations of the image forming apparatus 1. The controller 11 also controls operations of the image processing unit 12. The power source unit 13 applies voltage to the photosensitive units 30, the developing devices 40, the transfer device 50, and the like.

The image processing unit 12 converts print information received from an external information transmission apparatus (for example, a personal computer or the like) into image information for formation of a latent image and outputs drive signals to light exposure devices LH at preset timing.

The sheet feed devices 20 in which sheets of paper P are stacked are provided at a bottom portion of the image forming apparatus 1. The sheets P each serve as a medium. In each of the sheet feed devices 20, the position of the sheets P in the width direction is determined by a regulating plate (not illustrated), and the sheets P are drawn forward (−X direction) one sheet after another from a top sheet P of a stack of the sheets P by a sheet drawing unit 22.

The sheets P drawn from the sheet drawing unit 22 are each transported to a nip in a registration roller pair 23.

The photosensitive units 30 are provided above (Z direction) the sheet feed devices 20 so as to be parallel to one another. The photosensitive units 30 each include a corresponding one of rotating photosensitive drums 31. Yellow (Y), magenta (M), cyan (C), and black (K) toner images are formed on the respective photosensitive drums 31 by the respective developing devices 40.

Yellow (Y), magenta (M), cyan (C), and black (K) toners are supplied from respective toner cartridges T(Y), T(M), T(C), and T(K) to the respective developing devices 40.

The toner images of the colors formed on the photosensitive drums 31 of the respective photosensitive units 30 are sequentially electrostatically transferred (first transfer) onto an intermediate transfer belt 51 of the transfer device 50. Thus, superposed toner images are formed by superposing the toner images of the colors. The superposed toner images on the intermediate transfer belt 51 are collectively transferred by a second transfer roller 52 onto the sheet P fed from the registration roller pair 23 and guided by a transport guide.

A fixing nip (fixing region) is formed between a pair of a heating module 61 and a pressure module 62 in pressure contact with each other in the fixing device 60.

The sheet P onto which the toner images have been collectively transferred by the transfer device 50 and have not yet been fixed is transported to the fixing nip of the fixing device 60 through a transport guide 53. In the fixing nip, the toner images are fixed due to the effects of the pressure and heat applied by the pair of the heating module 61 and the pressure module 62.

Bending of the sheet P onto which a fixed toner image has been formed is corrected by a curl correcting device 65. Then, the sheet P is fed from an output roller pair 63 to the sheet transport device 70. The sheet transport device 70 outputs the sheet P to a sheet output tray T1 while cooling the sheet P in a sheet transport path S (FIG. 5A) with an airflow blown from a first air blowing fan 81.

Furthermore, in order to invert the sheet P for duplex printing or in order to output the sheet P with an image recording side of the sheet P facing upward, a transport direction is switched to an upward direction (Z direction) by a switching gate G1.

As has been described, the image forming apparatus 1 has a C-shaped transport path, that is, a sheet transport path of the image forming apparatus 1 from the sheet feed devices 20 to the output roller pair 63 through the second transfer roller 52 has a C shape. This may minimize the length of the transport path of the sheet P and minimize first printout time (FPOT), which is a time period from the start of printing to output of the first sheet.

(2) The Structure and Operation of the Sheet Transport Section

Figure 3A:
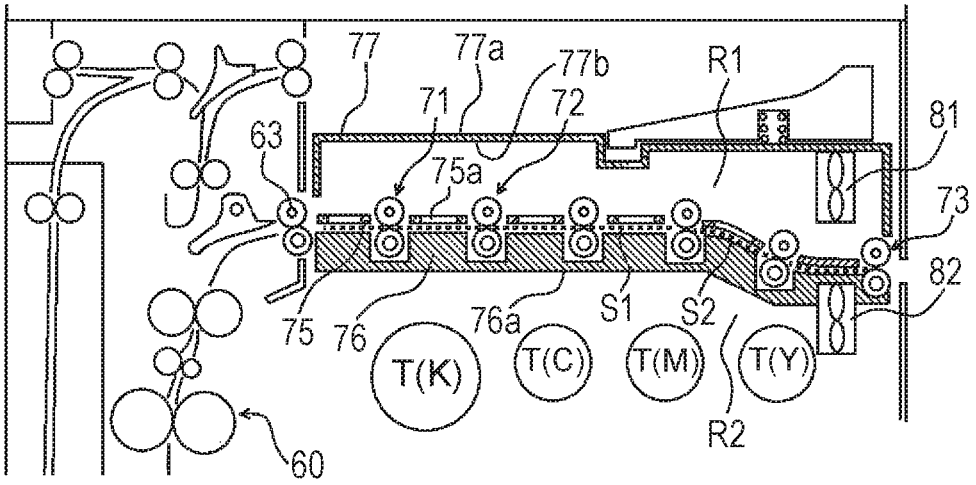
FIG. 3A is a schematic longitudinal sectional view of the sheet transport section of the image forming apparatus.
Figure 3B:
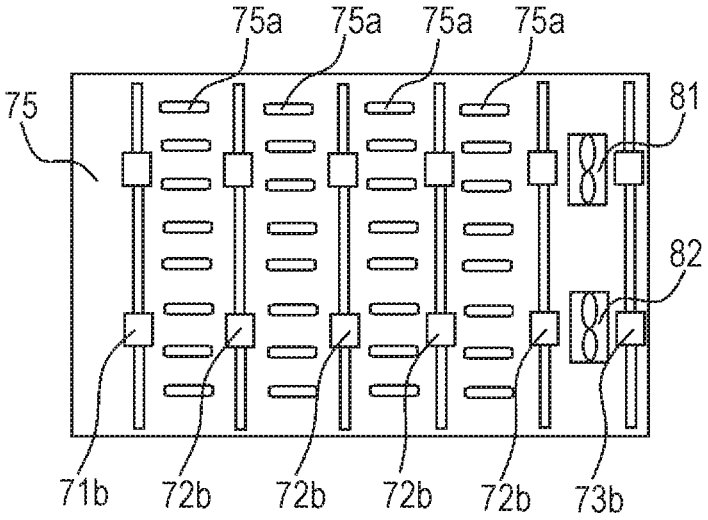
FIG. 3B is a schematic plan view of the sheet transport section.
Figure 4:
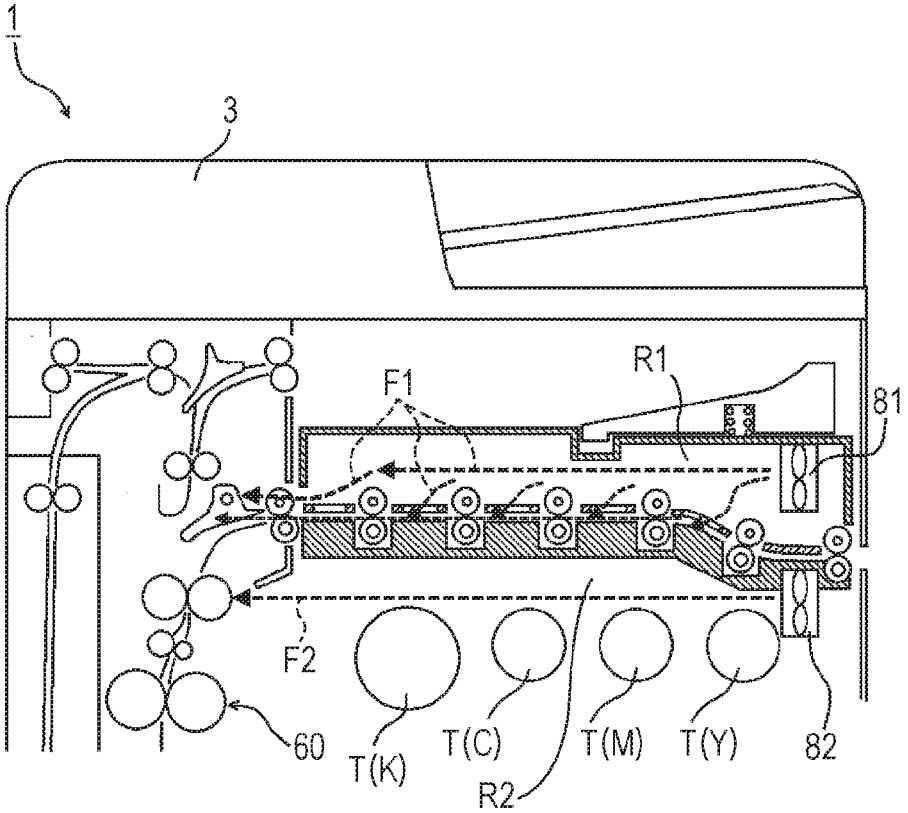
FIG. 4 is a schematic sectional view of the sheet transport section illustrating passage of air in the sheet transport device.
Figure 5A:
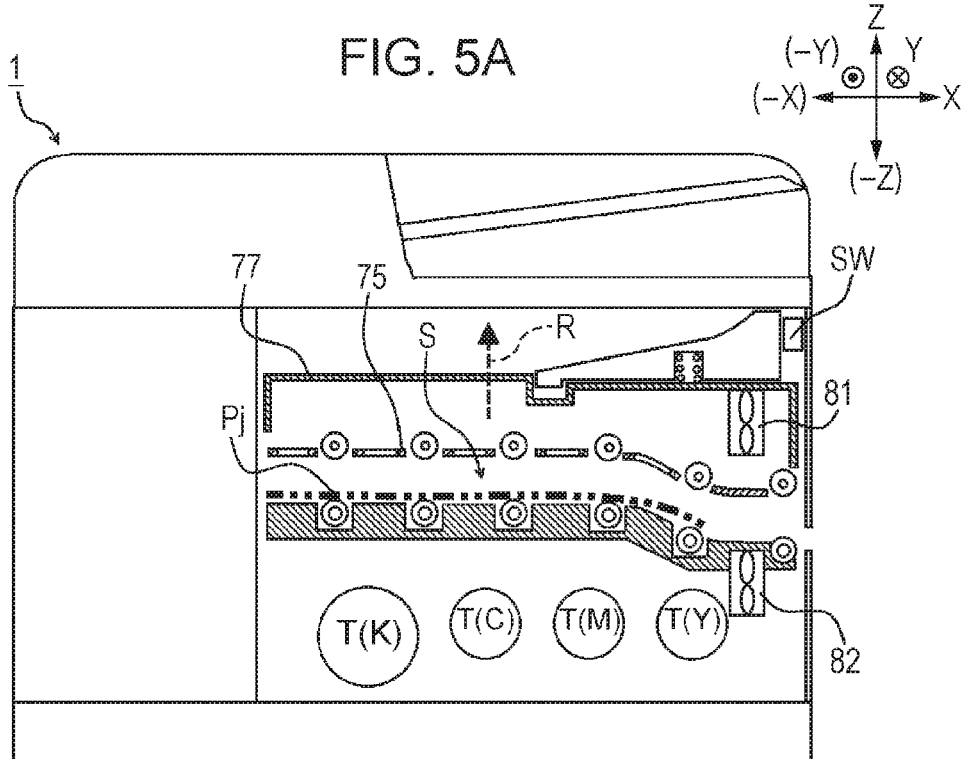
FIG. 5A is a schematic sectional view illustrating removal of jammed paper in the sheet transport device.
Figure 5B:
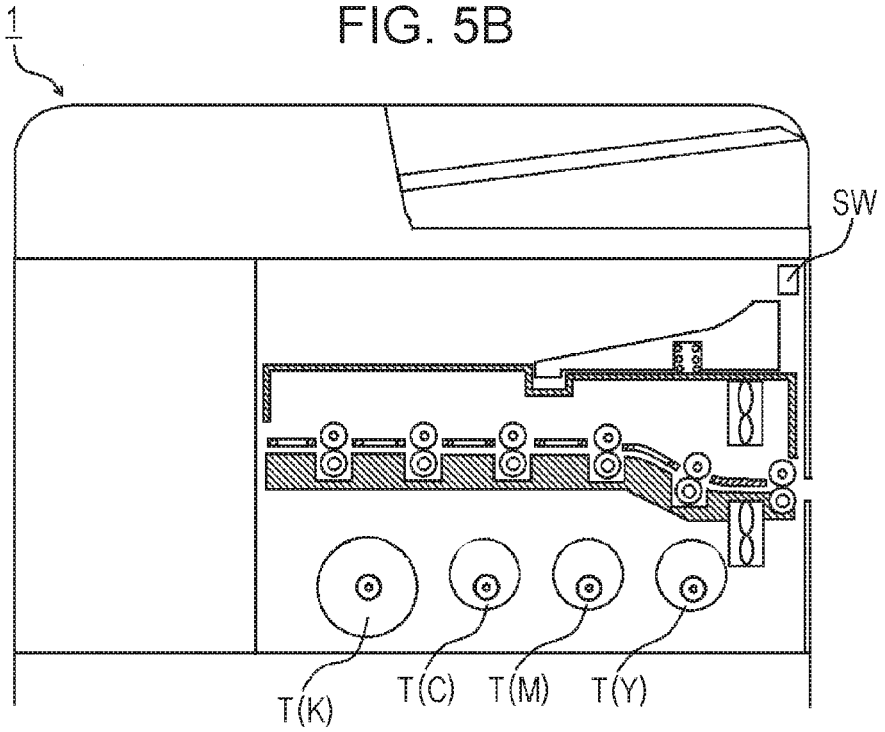
FIG. 5B is a schematic sectional view illustrating replacement of the toner cartridges.

FIG. 3A is a schematic longitudinal sectional view of the sheet transport section of the image forming apparatus 1, FIG. 3B is a schematic plan view of the sheet transport section, FIG. 4 is a schematic sectional view of the sheet transport section illustrating passage of air in the sheet transport device 70, FIG. 5A is a schematic sectional view illustrating removal of jammed paper in the sheet transport device 70, and FIG. 5B is a schematic sectional view illustrating replacement of the toner cartridges T(Y), T(M), T(C), and T(K).

The structure of the sheet transport section and cooling of the sheets are described below with reference to the drawings.

(2.1) The Structure of the Sheet Transport Section

As illustrated in FIG. 3A, the sheet transport section of the image forming apparatus 1 includes the sheet transport device 70, the first air blowing fan 81, and a second air blowing fan 82.

The sheet transport device 70 includes an entrance roller pair 71, plural transport roller pairs 72, and an output roller pair 73. The entrance roller pair 71 receives the sheet P output via the output roller pair 63 of the image forming apparatus 1. The transport roller pairs 72 transport the sheet P received by this entrance roller pair 71 to a downstream side. The output roller pair 73 outputs the sheet P toward the sheet output tray T1.

The entrance roller pair 71, the transport roller pairs 72, and the output roller pair 73 each include a pair of rollers. The sheet transport path S is formed between one and another rollers of each of the pairs of rollers by an upper transport member 75 and a lower transport member 76. The sheet transport path S guides the sheet P to the downstream side.

The sheet transport path S has a first transport path S1 and a second transport path S2. The first transport path S1 horizontally extends from the entrance roller pair 71 to the downstream side. The second transport path S2 is continuous with the first transport path S1 and curved to the image forming section 2 side so as to be directed to the output roller pair 73.

A sheet guide member 77 is formed above the sheet transport path S. The sheet guide member 77 has a sheet guide surface 77*a* on its upper surface. The sheet guide surface 77*a* guides and temporarily holds the sheet P which is to be inverted for duplex printing. A lower surface 77*b* opposite to the sheet guide surface 77*a* faces an upper surface of the upper transport member 75, thereby defining a space R1.

The first air blowing fan 81 and the second air blowing fan 82 are disposed on the downstream side of the sheet transport path S.

The first air blowing fan 81 is disposed on one end side of the sheet guide member 77, facing the space R1 defined by the lower surface 77*b* opposite to the sheet guide surface 77*a* and the upper surface of the upper transport member 75. The first air blowing fan 81 applies an airflow directed from the downstream side to an upstream side in a sheet transport direction on an upper side of the sheet P being transported through the sheet transport path S.

The second air blowing fan 82 applies an airflow directed from the downstream side to the upstream side in the sheet transport direction on the upper side of the toner cartridges T (Y), T (M), T (C), and T (K).

As illustrated in FIG. 3B, the upper transport member 75 has many air blowing openings 75*a*. The air blowing openings 75*a* are open toward the sheet transport path S and have a shape elongated in the sheet transport direction.

The entrance roller pair 71, the transport roller pairs 72, and the output roller pair 73 include respective drive rollers disposed in the lower transport member 76. The drive rollers are paired with respective pinch rollers 71*b*, 72*b*, and 73*b* rotatably disposed in the upper transport member 75, thereby transporting the sheet P in the sheet transport path S.

A lower surface 76*a* of the lower transport member 76 faces the toner cartridges T (Y), T (M), T (C), and T (K) so as to form an air channel R2 of the airflow applied from the second air blowing fan 82.

(2.2) Passage of Airflows

As illustrated in FIG. 4, the airflow blown from the first air blowing fan 81 into the space R1 defined by the lower surface 77*b* opposite to the sheet guide surface 77*a* and the upper surface of the upper transport member 75 flows into the first transport path S1 and the second transport path S2 through the air blowing openings 75*a* and passes along the upper surface of the sheet P to the upstream side in the sheet transport direction (see arrows F1 of FIG. 4).

The sheet P onto which the toner images have been fixed by the fixing device 60 is transported to the second transport path S2 while being cooled from the upper surface side by the air flowing from the air blowing openings 75*a* and passing to the upstream side in the sheet transport direction in the first transport path S1.

The sheet P being transported through the second transport path S2 is cooled by the air flowing through the air blowing openings 75*a* while being curved to the image forming section 2 side. Thus, the sheet P to which an upward curl is given with respect to the sheet transport direction is output to the sheet output tray T1 so as to be stacked on the sheet output tray T1.

The airflow applied from the second air blowing fan 82 passes from the downstream side to the upstream side in the sheet transport direction (see an arrow F2 of FIG. 4) through the air channel R2 formed by the lower surface 76*a* of the lower transport member 76 and toner cartridges T (Y), T (M), T (C), and T (K) that face the lower surface 76*a*, thereby suppressing diffusion of heat generated near the fixing device 60 toward the toner cartridges T (Y), T (M), T (C), and T (K) and cooling the toner cartridges T (Y), T (M), T (C), and T (K).

The airflows applied by the first air blowing fan 81 and the second air blowing fan 82 are exhausted to the outside of the image forming apparatus 1 by an exhaust fan (not illustrated) that exhausts heated air near the fixing device 60 to the outside of the image forming apparatus 1.

Thus, the sheet P heated by the fixing device 60 is cooled in the sheet transport path S extending from the output roller pair 63 to the output section above the image forming section 2 by the airflow applied from the first air blowing fan 81. This suppresses heat transmission to the toner cartridges T (Y), T (M), T (C), and T (K) side.

Furthermore, the heat generated near the fixing device 60 is intercepted by the airflow applied by the second air blowing fan 82, and accordingly, heat diffusion to the toner cartridges T (Y), T (M), T (C), and T (K) is suppressed.

As a result, an increase in temperature of the toner cartridges T (Y), T (M), T (C), and T (K) is suppressed, and accordingly, stable image formation may be continuously performed.

(2.3) Opening of the Sheet Transport Path

As illustrated in FIG. 1A, the image forming apparatus 1 includes the first front covering 1*a* and the second front covering 1*b*. The first front covering 1*a* shields the photosensitive units 30, the developing devices 40, and the transfer device 50 at a position above the sheet feed devices 20. The photosensitive units 30, the developing devices 40, and the transfer device 50 are included in the image forming section 2. The second front covering 1*b* serving as the opening closing member shields the toner cartridges T (Y), T (M), T (C), and T (K) and the sheet transport device 70 at a position above the first front covering 1*a*.

In order to remove jammed paper from the sheet transport path S of the sheet transport device 70, or in order to replace any of the toner cartridges T (Y), T (M), T (C), and T (K), the second front covering 1*b* is opened as illustrated in FIG. 1B to perform the removal of the jammed paper or the replacement of the toner cartridges T(Y), T(M) T(C), and T(K).

(2.3.1) Removal of Jammed Paper

As illustrated in FIG. 5A, when the second front covering 1*b* of the image forming apparatus 1 is opened, the sheet transport device 70 and the toner cartridges T (Y), T (M), T (C), and T (K) are exposed at the same time. In this state, the upper transport member 75 of the sheet transport device 70 is moved upward to open the sheet transport path S, that is, to enlarge a gap between the upper transport member 75 and the lower transport member 76 (see an arrow R of FIG. 5A). Thus, jammed paper Pj in the sheet transport path S may be removed.

After the jammed paper Pj has been removed, the upper transport member 75 is moved downward to form the sheet transport path S.

A switch SW (FIG. 1B) is provided between the second front covering 1*b* and a body of the image forming apparatus 1. The switch SW serving as a detector detects opening and closing of the second front covering 1*b*. When the second front covering 1*b* is closed after the jammed paper Pj has been removed, the closing of the second front covering 1*b* is detected by the switch SW.

When the second front covering 1*b* is opened, the opening of the second front covering 1*b* is detected by the switch SW. At this time, when the jammed paper Pj exists in the sheet transport device 70, it is expected that the sheet transport path S is opened next. Accordingly, power supply to the sheet transport device 70 is interrupted for consideration of safety of an operator.

(2.3.2) Replacement of the Toner Cartridges

As illustrated in FIG. 5B, when the second front covering 1*b* of the image forming apparatus 1 is opened so as to expose the sheet transport device 70 and the toner cartridges T(Y), T(M), T(C), and T(K) at the same time, each of the toner cartridges T(Y), T(M), T(C), and T(K) may be replaced by detaching and attaching the toner cartridge T(Y), T(M), T(C), and T(K) from the front (Y direction) of the image forming apparatus 1.

When the toner cartridge T(Y), T(M), T(C), and T(K) is replaced, the image forming section 2 including the sheet transport device 70 is in an operating state. The second front covering 1*b* is closed after the toner cartridge T(Y), T(M), T(C), and T(K) has been replaced.

When the second front covering 1*b* is opened, the opening of the second front covering 1*b* is detected by the switch SW. At this time, when the jammed paper Pj does not exist in the sheet transport device 70, it is expected that replacement of the toner cartridge T(Y), T(M), T(C), and T(K) is performed next. Accordingly, power supply to the sheet transport device 70 is not interrupted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms a toner image;

an output section;

a sheet transport unit that transports in a region above the image forming section a sheet onto which the toner image has been fixed toward the output section in a substantially horizontal direction;

a first air blowing device that applies on an upper side of the sheet being transported an airflow directed from a downstream side to an upstream side in a sheet transport direction of the sheet transport unit; and a second air blowing device that applies an airflow directed from the downstream side to the upstream side in the sheet transport direction of the sheet transport unit in a region that is on an upper side of the image forming section and on a lower side of the sheet.

2. The image forming apparatus according to claim 1, wherein the sheet transport unit includes an upper transport member and a lower transport member, wherein the upper transport member and the lower transport member form a sheet transport path, wherein the upper transport member has an air blowing opening that is open toward the sheet transport path and that extends in the sheet transport direction, and wherein the upper transport member is supported such that the upper transport member is movable between a guide position in which the upper transport member guides the sheet and an open position in which the sheet transport path is opened.

3. The image forming apparatus according to claim 2, wherein the sheet transport path of the sheet transport unit has a curved portion, and wherein the airflow is applied from the first air blowing device to the curved portion.

4. The image forming apparatus according to claim 3, further comprising:

an apparatus body; and an opening/closing member, wherein the opening/closing member is supported such that the opening/closing member is able to be set at a closed position and an exposing position, and wherein, at the closed position, the opening/closing member is closed relative to the apparatus body so as to cover the sheet transport path, and, at the exposing position, the opening/closing member is open relative to the apparatus body so as to expose the sheet transport path.

5. The image forming apparatus according to claim 4, wherein the opening/closing member is supported such that the opening/closing member is able to be opened and closed relative to the apparatus body so as to allow the image forming section and the sheet transport path, which are disposed in the apparatus body, to be simultaneously exposed, wherein, while the sheet is jammed in the sheet transport unit, power supply to the sheet transport unit is interrupted when the opening/closing member is opened, and wherein, while the sheet is not jammed in the sheet transport unit, the power supply to the sheet transport unit is not interrupted even when the opening/closing member is opened.

6. The image forming apparatus according to claim 2, further comprising:

an apparatus body; and an opening/closing member, wherein the opening/closing member is supported such that the opening/closing member is able to be set at a closed position and an exposing position, and wherein, at the closed position, the opening/closing member is closed relative to the apparatus body so as to cover the sheet transport path, and, at the exposing position, the opening/closing member is open relative to the apparatus body so as to expose the sheet transport path.

7. The image forming apparatus according to claim 6, wherein the opening/closing member is supported such that the opening/closing member is able to be opened and closed relative to the apparatus body so as to allow the image forming section and the sheet transport path, which are disposed in the apparatus body, to be simultaneously exposed, wherein, while the sheet is jammed in the sheet transport unit, power supply to the sheet transport unit is interrupted when the opening/closing member is opened, and wherein, while the sheet is not jammed in the sheet transport unit, the power supply to the sheet transport unit is not interrupted even when the opening/closing member is opened.

8. The image forming apparatus according to claim 1, wherein a sheet transport path having a curved portion is formed in the sheet transport unit, and wherein the airflow is applied from the first air blowing device to the curved portion.

9. The image forming apparatus according to claim 8, further comprising:

an apparatus body; and an opening/closing member, wherein the opening/closing member is supported such that the opening/closing member is able to be set at a closed position and an exposing position, and wherein, at the closed position, the opening/closing member is closed relative to the apparatus body so as to cover the sheet transport path, and, at the exposing position, the opening/closing member is open relative to the apparatus body so as to expose the sheet transport path.

10. The image forming apparatus according to claim 9, wherein the opening/closing member is supported such that the opening/closing member is able to be opened and closed relative to the apparatus body so as to allow the image forming section and the sheet transport path, which are disposed in the apparatus body, to be simultaneously exposed, wherein, while the sheet is jammed in the sheet transport unit, power supply to the sheet transport unit is interrupted when the opening/closing member is opened, and wherein, while the sheet is not jammed in the sheet transport unit, the power supply to the sheet transport unit is not interrupted even when the opening/closing member is opened.

11. The image forming apparatus according to claim 1, further comprising:

an apparatus body; and an opening/closing member, wherein a sheet transport path is formed in the sheet transport unit, wherein the opening/closing member is supported such that the opening/closing member is able to be set at a closed position and an exposing position, and wherein, at the closed position, the opening/closing member is closed relative to the apparatus body so as to cover the sheet transport path, and, at the exposing position, the opening/closing member is open relative to the apparatus body so as to expose the sheet transport path.

12. The image forming apparatus according to claim 11, wherein the opening/closing member is supported such that the opening/closing member is able to be opened and closed relative to the apparatus body so as to allow the image forming section and the sheet transport path, which are disposed in the apparatus body, to be simultaneously exposed, wherein, while the sheet is jammed in the sheet transport unit, power supply to the sheet transport unit is interrupted when the opening/closing member is opened, and wherein, while the sheet is not jammed in the sheet transport unit, the power supply to the sheet transport unit is not interrupted even when the opening/closing member is opened.

* * * * *